US005477015A

United States Patent [19]

Preslicka et al.

[11] Patent Number: 5,477,015

[45] Date of Patent: Dec. 19, 1995

[54] VEHICULAR MUFFLER WITH IMPROVED MECHANICAL LOCK JOINTS

[75] Inventors: A. J. Preslicka; Robert J. Paterick, both of Knoxville, Tenn.; Paul Smeltzer, Naperville, Ill.

[73] Assignee: Maremont Corporation, Naperville, Ill.

[21] Appl. No.: 131,559

[22] Filed: Oct. 4, 1993

Related U.S. Application Data

[63] Continuation of Ser. No. 82,230, Jun. 24, 1993, abandoned, which is a continuation of Ser. No. 885,821, May 20, 1992, abandoned, which is a continuation-in-part of Ser. No. 695,601, May 3, 1991, abandoned.

[51] Int. Cl.[6] ..... F01N 7/18

[52] U.S. Cl. ..... 181/282; 181/243

[58] Field of Search ..... 181/243, 249, 181/255, 264, 265, 267, 269, 272, 282; 29/263, 282; 138/161–168

[56] References Cited

U.S. PATENT DOCUMENTS

| | | | |
|---|---|---|---|
| 3,827,531 | 8/1974 | Hansen | 181/265 |
| 4,541,553 | 9/1985 | McQuillen, Jr. | 222/591 |
| 4,565,260 | 1/1986 | Scheidt et al. | 181/243 |
| 4,570,747 | 2/1986 | Ortyl | 181/243 |
| 4,821,391 | 4/1989 | Paterick | 29/263 X |

*Primary Examiner*—Richard A. Wintercorn
*Assistant Examiner*—J. K. Han
*Attorney, Agent, or Firm*—McAndrews, Held & Malloy, Ltd.

[57] ABSTRACT

A vehicular exhaust system muffler including a mechanical lock joint for joining the end tubes to the flow tubes. One end of each end tube has an outer diameter selected such that the one end may be loosely, telescopically and overlappingly fitted within the adjacent end of the adjacent flow tube. The overlapped ends of the end tubes and the flow tubes are mechanically locked together by a circumferential skewed bead formed in the overlapped ends, where the plane of the skewed bead is at an angle less than ninety degrees with respect to the central longitudinal axis of the overlapped ends. This mechanical locking maintains the relative axial positions of the overlapped ends and resists relative movement between the overlapped ends and between the internal panels and the wrapper due to the application of torsional and axial forces that the tubes experience during the assembly of the muffler. The muffler also employs a mechanical lock joint to lock the end tubes within apertures in the end panels of the muffler. The lock joint includes a continuous, circumferential bead formed in the end tube and an annular flange, integral with the end panel, which extends along the end tube and abuts the bead. A series spaced apart, circumferential, aligned elongated deformations are formed in the overlapped portion of the end tube and the flange.

28 Claims, 3 Drawing Sheets

VEHICULAR MUFFLER WITH IMPROVED MECHANICAL LOCK JOINTS

This is a continuation of then but now abandoned U.S. application Ser. No. 08/082,230 filed Jun. 24, 1993, which is a continuation of then co-pending but now abandoned application Ser. No. 07/885,821 filed May 20, 1992 which is a continuation-in-part of then but now abandoned application Ser. No. 07/695,601 filed May 3, 1991.

BACKGROUND OF THE INVENTION

The present invention relates to mufflers, and more particularly, mufflers for vehicular exhaust systems used with internal combustion engines and to methods of fabricating or manufacturing such mufflers.

Over the years, vehicular exhaust system mufflers, silencers, resonators and the like (hereinafter collectively referred to as "mufflers") have employed many different designs. Nevertheless, most mufflers have included one or more end tubes; one or more flow tubes that may be perforated, in whole or in part, so as to permit the expansion of the combustion gases within the muffler; one or more panels or baffles that are often described as end panels and internal panels, depending on their dispositions within the muffler, and that among other things serve to support the tubes; and an inner, and often an outer sheet metal body wrapper that serves as a housing for the other muffler components. Generally speaking, the fabrication of mufflers in the past has involved a number of steps, including the assembly of a reversing unit and end cap sub-assemblies.

In one muffler design, the reversing unit sub-assembly includes two internal panels and two flow tubes. The peripheral edge of each internal panel has an integral flange that projects perpendicularly from the plane of the panel. Each of the internal panels also includes one or more apertures, and each aperture is surrounded by an integral, perpendicularly projecting flange. The internal panels are disposed, side by side, so that in general, apertures in the panels are aligned in pairs.

In fabricating the reversing unit sub-assembly, the opposite ends of the flow tubes are secured within aligned apertures by a mechanical lock joint, such as a pair of continuous circumferential beads or a continuous circumferential bead and flaring the end of the tube The inner sheet metal wrapper is folded or configured into a generally oval or round shape so as to define a generally cylindrical volume into which the reversing unit sub-assembly may be inserted. The ends of the wrapper are joined together by seam locking, spot welding, seam welding or the like. One of the internal panels is inserted into the inner wrapper first and is called the leading panel. The internal panel, inserted into the inner wrapper last, is called the trailing panel.

At this point in the muffler fabrication, it has been customary to make a number of spot or tack welds between the inner wrapper and the peripheral flange on the trailing panel. These welds attach the trailing panel to the inner wrapper and thus locate the entire reversing unit sub-assembly relative to the inner wrapper.

The next step in the fabrication has been to apply an outer sheet metal wrapper around the assembled reversing unit sub-assembly and inner wrapper. The outer wrapper is shaped or configured about the inner wrapper such that the respective side edges of the two wrappers are adjacent. Its end edges are then seam locked together so as to hold the outer wrapper tightly in place over and around the inner wrapper.

Two end cap sub-assemblies are usually required to complete the fabrication of the muffler. Each end cap sub-assembly includes an end panel having a continuous peripheral edge. Each end panel has at least one aperture that is surrounded by a perpendicularly projecting, aperture surrounding flange. Each of the end tubes is disposed, between their ends, in its end panel aperture and is secured to the end panel by a mechanical lock joint such as shown in U.S. Pat. No. 4,565,260.

In the assembled muffler, an end of each end tube is usually connected with an end of a flow tube. In the past, the connected end of the end tube is sized so as it can be tightly press fit within the inside diameter of its associated flow tube end when the end cap assembly is brought adjacent to the side edge of the inner and outer wrappers. This press fitting requires the maintenance of close or narrow tolerances. The press fitting poses no problem with respect to dislocating the reversing unit sub-assembly, relative to the inner and outer wrappers because as noted, that sub-assembly is held in place within the wrappers by the plurality of spot or tack welds.

After the end tubes have thus been connected with the flow tubes, the side edges of the wrappers and the peripheral edges of the end panels are spun and crimped together. This completes the fabrication of the muffler.

While the above method of fabricating mufflers continues to produce a quality muffler product, the necessity of utilizing welds to hold the reversing unit sub-assembly, relative to the inner wrapper, is a time consuming and thus expensive step. Additionally such welding can pose potentially serious health and workplace safety concerns for the fabrication workers. Further such welding can adversely affect the integrity of the protective coating applied to the muffler components by creating a site of nucleation of corrosion. This defeats the purpose of applying the protective coating and of using mechanical lock joints. Those working in this art have long sought to eliminate having to weld during muffler fabrication.

The above-mentioned use of mechanical lock joints has reduced the use of welding—and its resultant disadvantages—in muffler fabrication. Nevertheless, to obtain sufficient torsional resistance for such a mechanical lock joint, such as, for example, the joint shown in U.S. Pat. No. 4,565,260, a die has to be used as a backup for the rotary tooling utilized to deform the tube surface into the joint. Moreover, tooling such as disclosed in U.S. Pat. No. 4,821,391, is required in order to form such mechanical lock joints on a production line basis. The cost of such tooling is relatively expensive, and the formation of the joints, even using such sophisticated tooling, is relatively time consuming. Thus, the art has also long been seeking improved mechanical lock joints that can secure against the torsional and axial forces normally experienced in mufflers during their assembly and that can be relatively quickly and inexpensively formed.

SUMMARY OF THE INVENTION

In its principal aspect, the present invention eliminates the need for any welding in the fabrication of vehicular exhaust system mufflers through the use of a novel approach to assembling the overlapped ends of the end and flow tubes and the employment of improved mechanical lock joints. Not only are these novel mechanical lock joints able to resist the torsional and axial forces normally experienced by the muffler components during fabrication and use of the muffler, but by reason of their utilization, the muffler can be fabricated in much less time and at significantly less cost.

One of these improved mechanical lock joints is formed between the telescoping, interfitted, overlapped ends of the flow and end tubes and the internal panel supporting these tubes. By using this improved mechanical lock joint, the overlapping interfitted ends of the end tube and flow tube need not be press fit together. Rather, the size of the telescoping end tube end is preselected so that it loosely fits within the end of the flow tube. Consequently, there is no possibility that any significant force will be applied to the reversing sub-assembly unit during the assembly of the end cap sub-assemblies to the muffler. This, in turn, obviates the need to weld or otherwise secure the reversing unit sub-assembly to the inner wrapper.

The usage of this improved mechanical lock joint also permits an important easing of the manufacturing tolerances with respect to the sizing of the overlapping ends of the end and flow tubes and with respect to the axial locations of these ends, relative to each other and to the internal panel aperture flange. Heretofore close tolerances had to be maintained. This easing of the tolerances minimizes the manufacturing time required and reduces scrap.

The present invention also contemplates the use of another improved mechanical lock joint. This novel lock joint is formed between the end tube and internal panel and has particularly utility in joining tube and panel together.

In contrast to mechanical lock joints previously utilized in the fabrication of mufflers, both improved mechanical lock joints of the present invention can be formed without the use of back-up dies. This makes the tooling required for forming the improved mechanical lock joint significantly less expensive, and the fabrication of this lock joint much less time consuming as compared to the fabrication of prior mechanical lock joints, such as shown in U.S. Pat. Nos. 4,565,260 and 4,570,747.

Accordingly, it is a principal object of the present invention to provide an improved muffler for a vehicular exhaust system used with an internal combustion engine and also to provide an improved method for fabricating or making such a muffler.

Another object of the present invention is to provide an improved muffler and muffler fabrication method, as described, where welding need not be used in the fabrication of the muffler and where the improved mechanical lock joints utilized to fabricate the muffler can be readily and relatively inexpensively formed under relatively relaxed manufacturing tolerances and by the use of tooling that does not require the employment of back up dies. A related object of the present invention is to provide an improved muffler which employs an improved mechanical lock joint to attach the overlapped telescoped ends of interfitted tubes to each other and to the aperture flange of an internal panel, where this lock joint includes a substantially continuous, circumferential, skewed bead, where the plane of this bead is disposed at an oblique angle of less than 90° with respect to the longitudinal axes of the tubes, and where the bead extends from beyond one side of the panel to beyond the distal end of the panel's aperture flange on the other side of the panel. Another related object of the present invention is to provide an improved muffler which employs an improved mechanical lock joint where a circumferential, generally continuous, series of zig-zag arranged beads, where one end of the zig-zag beads extends beyond one side of the panel, and where the other ends of the zig-zag beads extend beyond the distal end of the panel's aperture flange on the other side of the panel.

A further object of the present invention is to provide an improved muffler which employs an improved mechanical lock joint to attach an end tube to an end panel, where the lock joint includes a series of spaced apart, circumferential, aligned, elongated deformations in the overlapped portions of the end tube and the end panel aperture flange; where a substantially continuous, circumferential bead is formed in the part of the end tube adjacent to other side surface of the end panel (that is, the side surface opposite the panel's aperture flange), where the plane of these deformations is at an angle of substantially 90° with respect to the longitudinal central axis of the end tube; where preferably the major axes of these deformations are aligned with the plane of the deformations; and where the plane of the circumferential bead is at an angle of substantially 90° with respect to the longitudinal axis of the end tube.

Still another object of the present invention is to provide an improved muffler of the type described which includes a wrapper that has been configured or shaped so that its inner surface defines a volume, between its side edges, having a predetermined cross-sectional configuration; which has a first panel having a peripheral edge generally congruent with the predetermined cross-sectional configuration so that when the panel is disposed within the volume, the peripheral flange of the panel is in contact with but is metallurgically unbonded to the inner surface of the wrapper; where one tube is disposed, at least in part, within the volume so that its one end is disposed within and extends through an aperture in the panel, with the end of the one tube having a preselected inner diameter; where another tube extends from without to within the volume, with the other tube having a first end that has a preselected outer diameter so that this end of the other tube interfits loosely, telescopically, and overlappingly within the first end of the one tube so as to minimize the possibility that the forces applied in assembling the ends of the tubes will cause axial displacement of the panel relative to the wrapper and with the end of the other tube extending within the end of the one tube to a point beyond the plane of the panel; and which includes a mechanical lock joint for locking together the telescoped or interfitted, overlapped ends of the tubes so as to maintain the relative axial positions of the overlapped ends and to resist relative movement between the overlapped ends due to the application of torsional and axial forces that the tubes experience during normal assembly of the muffler. A related object of the present invention is to provide an improved muffler of the type described where the other tube extends through an aperture in a second panel; and where another mechanical lock joint is formed for locking the other tube within the second panel aperture; and which includes still another mechanical lock joint for locking the one tube in the first panel aperture.

A still further object of the present invention is to provide an improved method of fabricating or manufacturing a muffler of the type described, where the method includes the steps of placing an end of the flow tube into and through an aperture in the internal panel; mechanically locking this end of the flow tube in the internal panel aperture; shaping a sheet metal wrapper into a configuration generally corresponding to the outer configuration of the periphery of the internal panel; joining the ends of the wrapper together; placing the mechanically locked flow tube and internal panel within the shaped configuration of the wrapper so that inner surface of the wrapper is in contact with but is metallurgically unbonded to the peripheral edge of the internal panel; placing an end tube within an aperture in a end panel; mechanically locking the end tube within the end panel aperture; mounting the mechanically locked end tube and end panel onto the side of the wrapper so that an end of the end tube is loosely, telescopically and overlappingly fitted within the end of the flow tube so as to minimize the chances that the forces applied during the mounting will cause displacement of the internal panel relative to the wrapper; mechanically locking together the overlapped ends of the flow and end tubes so as to maintain the relative axial positions of these overlapped ends and to resist relative movement between the overlapped ends due to the application of torsional and axial forces that are normally experienced by these tubes during the fabrication of the muffler and during the assembly of the muffler with the vehicular exhaust system; and mechanically joining the side edge of the wrapper and the peripheral edge of the end panel.

These and other objects, aspects and advantages of the present invention are more fully set forth in the following detailed description of the preferred embodiment of the present invention, which follows a brief description of the accompanying drawings.

DESCRIPTION OF THE PREFERRED EMBODIMENTS

Figure 1:
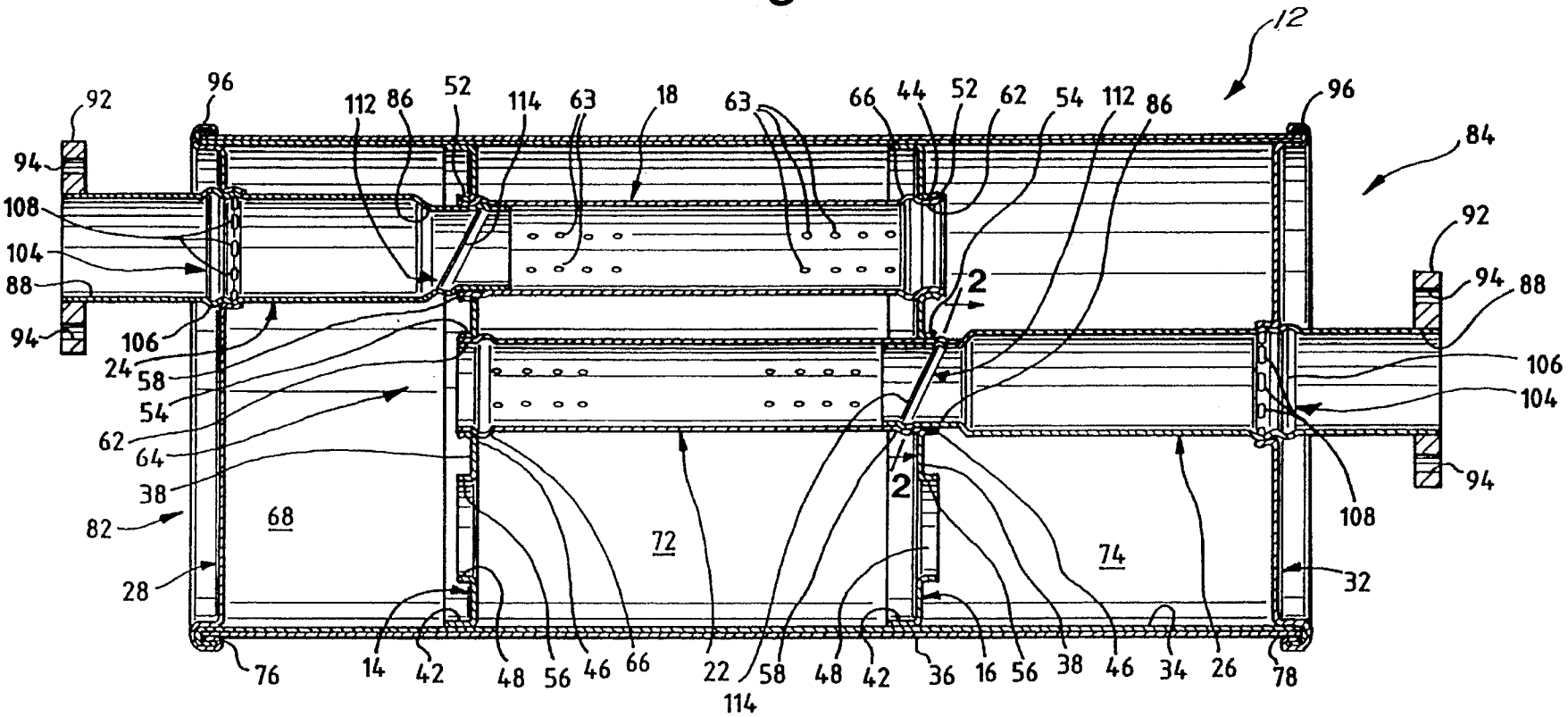
FIG. 1 is a cross-sectional view taken along a vertical plane, including the central longitudinal axis, of the improved muffler of the present invention.
Figure 2:
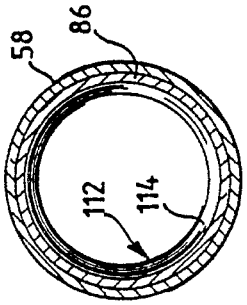
FIG. 2 is a cross-sectional view taken along the line 2—2 in FIG. 1.

Referring now to FIG. 1, an improved muffler of the present invention is shown generally at 12. This muffler includes two internal panel or baffles 14 and 16, two partially perforated flow tubes 18 and 22, two end tubes 24 and 26, two end panels 28 and 32, an inner sheet metal body wrapper 34, and an outer sheet metal body wrapper 36. For all intents and purposes, the structure and function of each of the two internal panels, the two flow tubes, the two end tubes, and the two end panels are substantially identical except as hereinafter noted. Hence, only one of each of them will be described in detail, and their common component parts will be indicated by same reference numerals.

The internal panel 14 includes a generally flat body 38 that has a generally oval or round shaped peripheral edge. An integral edge flange 42 projects perpendicularly from the plane of the body 38. The panel 14 also includes upper, middle and lower circular apertures 44, 46 and 48, respectively. The diameters of the apertures maybe the same. These apertures are, in turn, surrounded or circumscribed by integral flanges 52, 54 and 56, respectively. The inner diameter of the flanges 52, 54 and 56 are the same as the diameters of the apertures 44, 46 and 48, respectively. These flanges project generally perpendicularly and in the same direction from the plane of the panel body 38. As noted, the structure of the internal panel 16 is identical to that of internal panel 14.

The flow tubes 18 and 22 are shorter in length than the overall length of the muffler 12. The tubes 18 and 22 have circular cross-sections and their side walls, between their ends 58 and 62, are perforated, as generally indicated at 63, so as to permit the expansion of exhaust gases within the muffler. The ends 58 of the tubes have inner diameters that are preselected so that they may each receive an end of one of the end tubes 24 and 26 as hereinafter described. The other ends 62 of the flow tubes 18 and 22 are adapted to remain free of contact with other tubes. The outer diameters of the ends 58 and 62 are selected so that they fit within the apertures 44, 46 and 48 and the flanges 52, 54 and 56.

The internal panels 14 and 16 and the flow tubes 18 and 22 are the components of a reversing unit sub-assembly, shown generally at 64. This sub-assembly is fabricated by placing the internal panels 14 and 16 in a spaced apart, parallel fashion so that the apertures 44 and the apertures 46 in the panels 14 and 16 are axial aligned and so that the flanges 52, 54 and 56 of the panels face outwardly or away from each other. The flow tube 18 is disposed in the pair of aligned, upper apertures 44, and the flow tube 22 is disposed in the pair of aligned middle apertures 46. Specifically, the preselected sized end 58 of the flow tube 18 is disposed within the aperture 44 of the panel 14 while its other end 62 is disposed within the aperture 44 of the panel 16. Both of the ends 58 and 62 of the tube 18 are surrounded by and fit closely within the aperture flanges 52 of the panels 14 and 16.

Similarly the ends 58 and 62 of the flow tube 22 are disposed within the apertures 46 of the internal panels 16 and 14, respectively, and fit closely within the flanges 54 which surround the middle apertures 46 in the internal panels. The end 58 of the flow tube 22 is disposed within the aperture 46 of the panel 16 while end 62 is disposed within the aperture 46 of the panel 14.

Figure 4:
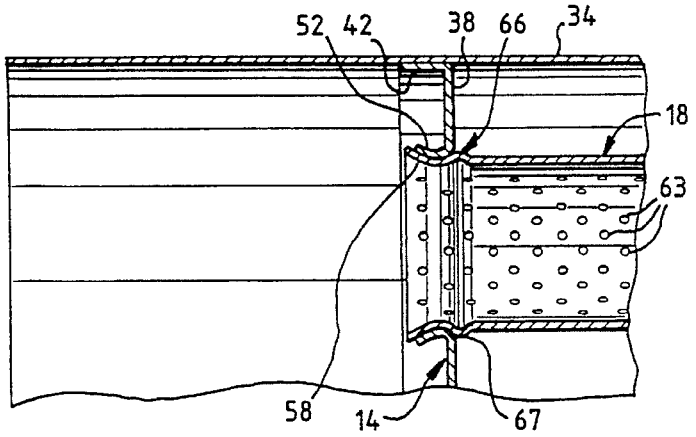
FIG. 4 is an enlarged, partial, cross-sectional view showing an end of a flow tube mechanically locked within an internal panel aperture.
Figure 6:
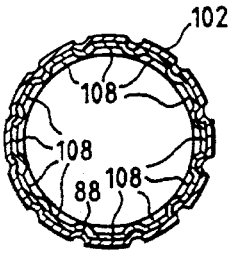
FIG. 6 is a cross-sectional view taken along the line 6—6 in FIG. 5.

As best illustrated in FIGS. 1 and 4, a mechanical lock joint, generally indicated at 66, is employed to lock the ends 58 and 62 of the flow tubes 18 and 22 to the panels. This lock joint 66 is preferably somewhat similar, in part, to that described in U.S. Pat. No. 4,570,747. The lock joints 66 includes continuous circumferential beads 67, as best illustrated in FIG. 4. These beads 67, together with the flaring of the distal ends of the aperture flanges 52 and 54 and the ends of the ends 58 and 62, serve to lock the flow tubes 18 and 22 to the panels 14 and 16 so as to form the relatively rigid sub-assembly 64.

The inner wrapper 34 is made from a generally rectangular sheet metal panel or sheet to which conventional tooling has been applied so as to form the wrapper into an open ended enclosure. Specifically, the wrapper is shaped or configured so that its inner surface defines a generally oval shaped, cross-sectional volume that is congruent, in cross-section, to the outer shape of the edge flanges 42 on the internal panels 14 and 16. When thus configured, the adjacent end edges of the wrapper are joined together, preferably seam locked, in a conventional manner.

After the inner wrapper 34 has thus been formed, the reversing unit sub-assembly 64 is inserted inside it through one of the side openings defined by one of the side edges of the wrapper. The sub-assembly 64 is positioned or disposed within the interior of the wrapper 34 such that the internal panels 14 and 16 roughly divide the interior into three equal chambers; a left hand chamber 68, a central chamber 72, and a right hand chamber 74, as illustrated in FIG. 1.

The edge flanges 42 of the internal panels 14 and 16 are in close contact with the inner wall of the inner wrapper 34. Unlike prior mufflers, no welding or other metallurgical bonding is needed to hold the reversing unit sub-assembly 64 in place within the inner wrap 34. The close contact between the end flanges 42 and the inside surface of the inner wrapper 34 serves to retain the sub-assembly 64 in place during subsequent assembly of the muffler 12. It is, however, contemplated that in certain inward deformations of the wrapper 34, on both sides of each edge flange 42, may be used to "trap" the panels 14 (that is, assist in holding the panels) vis-a-vis the wrapper. As noted, the fact that the panels 14 do not need to be secured to the wrapper 34 by welding or some other metallurgical bonding is an important advantage of the present invention since, among other things, welding or other metallurgical bonding usually destroys the integrity of the metal protective coating that is conventionally applied to the wrapper 34 and other components of the muffler 12.

After the reversing unit subassembly 64 is disposed within the inner wrapper 34, the outer wrapper 36 is formed so that it is shaped or configured about the inner wrapper 34. Like the inner wrapper 34, the outer wrapper 36 is made from a generally rectangular sheet metal panel sheet. It is shaped or configured about the outer surface of the inner wrapper 34 so that it closely conforms with the outer shape or configuration of the inner wrapper. The adjacent, end edges of the outer wrapper 36 are then joined together, again preferably by seam locking them in a conventional manner. The side edges of the outer wrapper 36 are generally aligned with and closely adjacent to the side edges of the inner wrapper 34. The left and right pairs of side edges of the wrappers 34 and 36 are respectively indicated at 76 and 78 in FIG. 1.

Two end cap sub-assemblies 82 and 84 are next assembled onto the muffler 12 during its fabrication. Each of these sub-assemblies is structurally and functionally identical except as hereinafter noted. Because of this, only one of these sub-assemblies 82 and 84 will be described in detail but the same reference numerals will be used to indicate identical parts in both.

Figure 3:
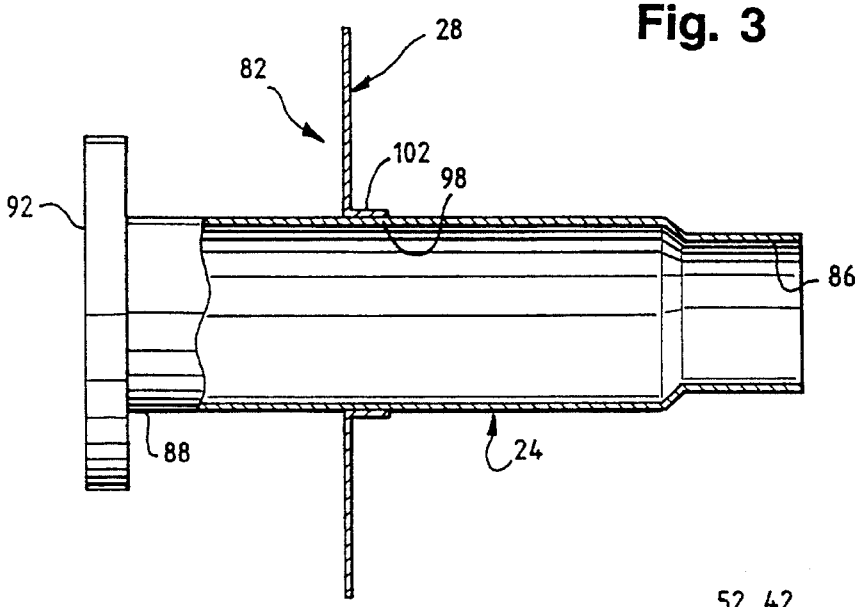
FIG. 3 is an enlarged, partial, cross-sectional view of an end tube disposed within an end panel aperture prior to the formation of the mechanical lock that is used to attach these components.

Referring now to FIGS. 1 and 3, the end cap sub-assembly 82 comprises the end tube 24 and the end panel 28. As hereinafter discussed, the end tube 24 is mounted on the end panel 28 such that the longitudinal axes of the tubes 18 and 24 are substantially aligned when the sub-assembly 82 is assembled or mounted on the left hand end of the muffler 12, as shown in FIG. 1.

End tube 24 includes an inner end 86 and an outer end 88. The tube 24 is of uniform diameter except adjacent to its inner end 86. At that end, it is swaged down or otherwise reduced in size so that its outer diameter has a preselected size, relative to the inner diameter of the end 58 of the flow tube 18. More specifically, the outer diameter of the inner end 86 of the tube 24 is preselected whereby it can be telescopically, overlappingly and importantly, loosely and easily interfitted within the end 58 of the flow tube 18. The length of the inner end 86 is also preselected. Its preselected length permits the end to be telescopically received within the end 58 such that the distal end or leading edge of the end 86 may be disposed or located beyond the plane of the body 38 of the internal panel 14. Because of the differences in the sizes of the outer diameter of the end 86 and the inner diameter of the end 58—which results in a loose fit therebetween—the insertion of the end 86 of the tube 24 within the end 58 of the tube 18 does not impart or apply any significant forces to the flow tube 18 or the sub-assembly 64, and accordingly, cannot and does not cause any axial displacement of the subassembly 64, including the panels 14 and 16, with respect to the wrappers 34 and 36.

A clearance of 0.030 inches between these tube ends 58 and 86 has generally been found to be satisfactory. For example, where the nominal inner diameter of the end 58 of the flow tube 18 is 1.94 inches, the nominal outer diameter of the reduced inner end 86 of the end tube 24 would be 1.91 inches, with a tolerance of plus or minus 0.010 inches.

As illustrated in FIG. 1, the tube 22 is positioned in the middle apertures 54 of the internal panels 14 and 16. The tube 26 is mounted on and positioned, with respect to the end cap sub-assembly 84, so that the longitudinal axes of the tubes 22 and 26 are aligned when the sub-assembly 84 is mounted or assembled on the right end of the muffler 12. The reduced inner end 86 of the tube 26 is disposed within the receiving end 58 of the flow tube 22 in a similar manner.

The outer end 88 of the tube 24 includes a relatively large diameter flange 92. This flange may be attached to the tube 24, for example, by conventional welding techniques, and is adapted to connect the tube 24, and the sub-assembly 82 and thus, the entire muffler 12, to other parts of a vehicular exhaust system, not shown. For this purpose, the flange 92 includes a plurality of bolt receiving holes 94, as shown in FIG. 1.

The peripheral shape of the end panel 28 is congruent with the opening defined by the side edges 76 of the inner and outer wrappers 34 and 36. It is sized so that the panel 28 covers or "fills" that opening and so that its peripheral edge is adjacent to the side edges 76 of the inner and outer wrappers 34 and 36. The panel's peripheral edge 96 and the side edges 76 are joined together, preferably by spinning and crimping in a conventional matter, to close the opening defined by the side edges 76. Alternatively on some mufflers, only the inner wrapper is mechanically locked with the peripheral edge 96 while the side edge of the outer wrapper is "trapped" between the spun edges of the end panels and the inner wrapper.

As illustrated in FIGS. 1 and 3, a circular aperture 98 is included in the panel 28 and is surrounded by a generally perpendicularly projecting flange 102 that is integral with the body of the panel 28. The size of the aperture 98 is selected so that it tightly receives the end tube 24, between its ends. When the end cap sub-assembly 82 is assembled or mounted on the muffler 12, the flange 102 is directed toward the sub-assembly 64, that is, toward the end 86 of the tube 24.

An improved and novel mechanical, gas tight, lock joint 104 attaches the end tube 24 within the end panel aperture 98 and to the end panel 28. This lock joint 104 includes a substantially continuous circumferential bead 106 formed in the part of the tube 24 adjacent to the left or outwardly facing side (as shown in FIG. 1) of the end panel 28. The plane of this bead 106 is substantially perpendicular to (or at an angle of 90° ) with respect to the longitudinal central axis of the tube 24. The protruding portion of the bead 106 has a diameter which is greater than the diameter of the aperture 98 and is positioned so that the inner facing side of the bead abuts or contacts the adjacent part of the panel 28. The bead 106 has a generally semicircular cross-section, taken perpendicular to the plane of the bead, but has somewhat of a segmented, or interrupted appearance as a result of it being formed by the use of a segmented, expanding mandrel.

The lock joint 104 also includes a series or plurality of spaced apart, circumferential aligned and equispaced, elongated non-spherical deformations or protrusions 108 that are formed in the portion of the end tube 24 underlying the flange 102 and also in the flange 102. These deformations are formed so that their outer side may abut or contact the adjacent part of the panel 28. The outer radial diameter or dimensions of these deformations 108 is larger than the diameter of the aperture 98. The plane of these deformations 108 is perpendicular to (or at an angle of essentially 90° ) with respect to the longitudinal central axis of the end tube 24. The major axes of these deformations 108 are preferably aligned with this plane of the deformations. However, the deformations 108 will also serve to increase the torsional strength of the joint 104 if their major axes are aligned at other angles with respect to the plane of the deformations. The circumferential distance between adjacent deformations 108 is about one half of the circumferential length of the deformations.

As an example of the relative dimensions involved—where the nominal outside diameter of the end tube 24 is 2.00 inches and where the diameter of the aperture 98 is 2.00 inches—the outer diameter of bead 106 is 2.25 inches, and the outer diameters of the deformations 108 are 2.25 inches. In such a lock joint 104, there will be as many as 12 deformations 108, each having a length in the plane of the deformations, of approximately 0.31 inches and a width, in a direction parallel to the longitudinal central axis of the tube 24, of approximately 0.21 inches.

The bead 106 and deformations 108 of the lock joint 102 may, as noted above, be formed by inserting conventional tooling, such as a segmented expanding mandrel within the end tube 24. Once inserted and appropriately located with respect to the panel 28, the tooling is expanded in a conventional manner. Back-up dies are, however, not required to form a bead and the deformations that will satisfactorily attach the end panel 28 and the end tube 26 together and that will support the torsional loads applied to the tube 24. This makes the overall tooling significantly less expensive and the fabrication of the joint 104 much less time consuming.

As noted above, when the end cap sub-assembly 82 is assembled or mounted on the left hand end (as shown in FIG. 1) of the muffler 12, the inner end 86 of the end tube 24 is loosely interfitted within the end 58 of the flow tube 18. As also noted above, the length of the inner end 86 is selected such that its distal end extends into the end 58 to a point beyond the plane of the body 38 of internal panel 14. Although the tolerances on the exact location of the distal end of the end 86, vis-a-vis the body 38, are not particularly close or critical, it should extend beyond the plane of the body 38 by at least approximately 0.5 inches.

The inner end 86 of the tube 24 is locked within the end 58 by a novel mechanical, gas tight lock joint 112. It is because of the use of this lock joint 112 that the exact position of the distal end of the end 86 vis-a-vis the plane of body 38, the tolerances between the outer diameter of the inner end 86 and the inner diameter of the end 52 are not critical and are much more relaxed than were required when the inner end of the end tube had to be press fit within a flow tube. This easing or relaxation of the manufacturing tolerances, reduces the time required for and thus the cost of assembling the muffler 12.

More specifically, the lock joint 112 comprises a continuous, circumferential, skewed bead 114 that is formed in and between portions of the inner end 86, the end 58 and the flange 52. The bead generally describes an ellipse or oval in the flat plane of this bead, which plane is skewed or disposed at an oblique angle, that is, an angle less than 90°, with respect to the central longitudinal axes of the end and flow tubes. Preferably, this angle is approximately 75 degrees.

Figure 5:
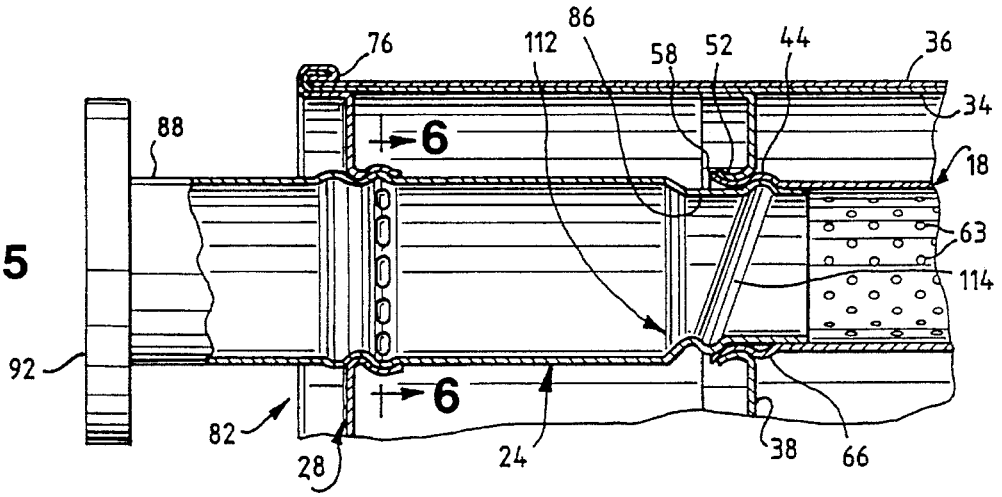
FIG. 5 is an enlarged, partial sectional view showing the mechanical lock joint between the overlapped ends of the flow and end tubes as well as the mechanical lock joint used to attach the end tube to the end panel.

Because of this skewing of the bead 114, the bead intersects and crosses the plane of the body 38 of the internal panel 14. Specifically, and as best shown in FIGS. 1 and 5, portions of the bead 114 are formed in and between the flange 52, the underlying distal end of the end 58, and the underlying part of the inner end 86 that are to the left of the plane of the body 38. Other portions of the bead 114 are formed in and between the inner end 86 and the overlying part of the flange 52 that are to the right (as illustrated in FIGS. 1 and 5) of the plane of the body 38. More specifically, the bead 114 maintains the relative axial positions of the overlapped ends of the tubes 18 and 24 and resists relative movement between the overlapped ends due to the application of torsional and axial forces that these tubes experience during the assembly of the muffler 12. The bead 114 is substantially continuous and extends beyond the plane or side surface of the panel 14 on the panel's right hand side (as seen in FIGS. 1 and 5), and beyond the distal end of the flange 52 on the left hand side. Because it is preferably made by a conventional segmented, expanding mandrel, it has somewhat of an interrupted or segmented looking appearance. Generally speaking, however, it has a semi-circular cross-section.

As an example of the pertinent, relative dimensions, the bead 114 has a major diameter of approximately 2.12 inches and a minor diameter of approximately 2.00 inches when used with tube 18 and 24 where the outer diameters of the inner end 86 and the end 52 are approximately 1.94 and 2.06 inches, respectively. Generally it has a cross-sectional shape with a radius of about 0.09.

As noted, the bead 114 may be formed by conventional tooling not shown. Such tooling may be inserted into the end tube 24 through its other or outer end 88 when the sub-assembly 82 is assembled or mounted on the muffler 12. Like the bead 106 and deformations 108 formed in the lock joint 104, the bead 114 can be satisfactorily formed without the use of back up dies. This significantly reduces the cost of the overall tooling and requires much less time to form the bead while permitting the bead to provide both axial and torsional support for loads applied to the lock joint 112.

As an alternative to the lock joint 112, an improved and novel mechanical lock joint 118 may be employed to attach the interfitted, overlapped end 86 of the tube 24 to the end 58 of the tube 18 and to the flange 52 of the body 38 of the panel 14. Like the joint 112, the joint 118 maintains the relative axial positions of the overlapped ends 58 and 86 and resist relative movement between the overlapped ends due to the application of torsional and axial forces that the tubes may experience during fabrication of the muffler and during assembly of the muffler with the vehicular exhaust system.

Figure 7:
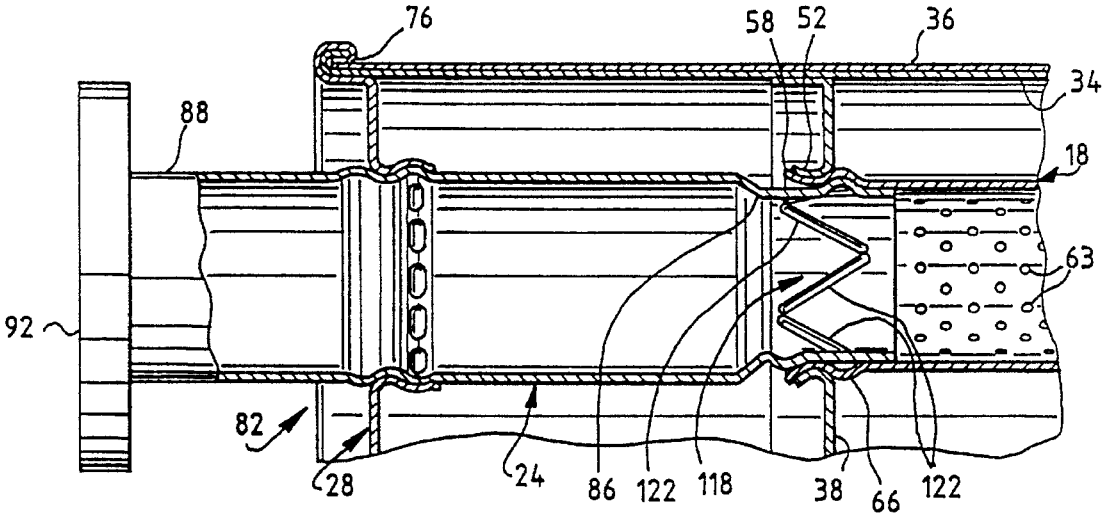
FIG. 7 is an enlarged, partial cross-sectional view that is similar to the view of FIG. 5 except that it shows an alternative mechanical lock joint between the overlapped ends of the flow and end tubes.

The joint 118 comprises a circumferential (circumferentially arranged), generally continuous series of zig-zag arranged beads 122 as best shown in FIG. 7. The beads 122 are substantially similar to each other in length, width and depth (height) and continue, end to end, around the circumferences of the tubes 18 and 24 and the flange 52. The one ends (that is, the right hand ends, as seen in FIG. 7) of the beads 122 extend longitudinally beyond (to the right of) the plane of the surface of the panel body 38. The other ends (that is, the left hand ends, as seen in FIG. 7) extend beyond the distal end of the flange 52.

Figure 8:
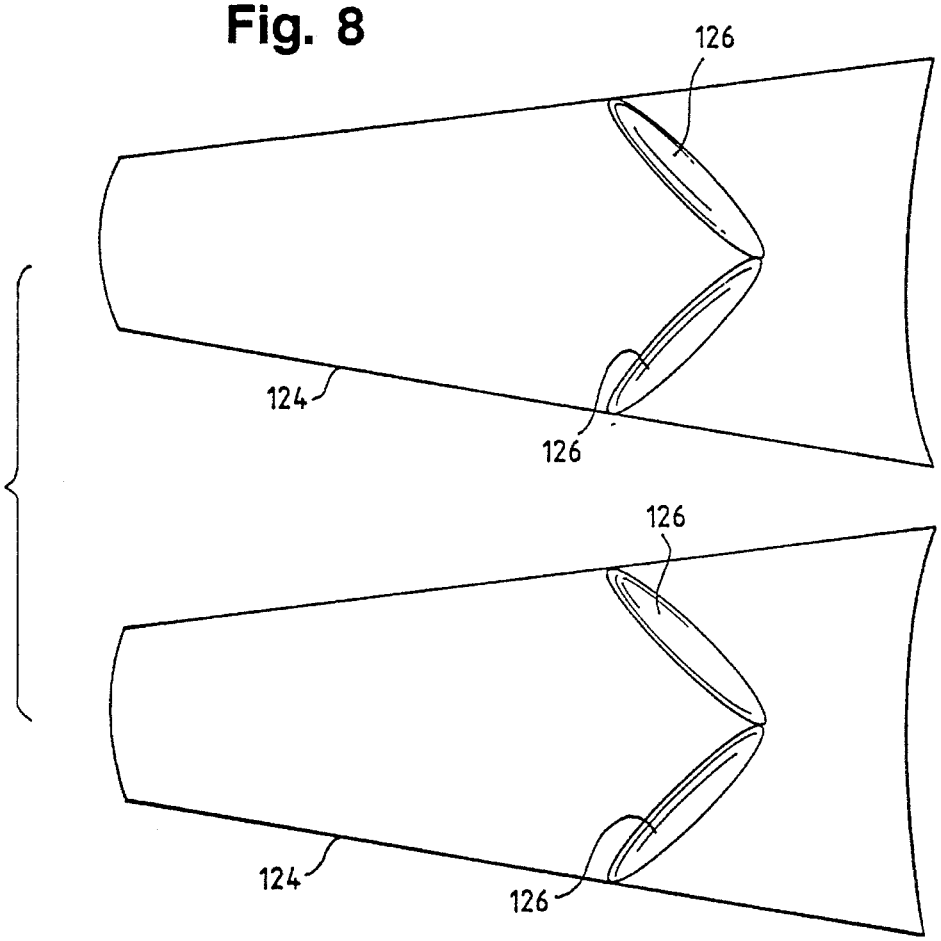
FIG. 8 is a partial top plan view of two expanding segmented "fingers" or parts of the otherwise conventional tooling that may be utilized to form the alternative mechanical lock joint shown in FIG. 7.

As with the joint 112, the joint 118 may be formed by conventional tooling that may be inserted within the tube 24 and that does not require back-up dies. A set of expanding mandrel, segmented fingers or parts 124, two of which are illustrated in FIG. 8, may be used to form the beads 122 of the joint 118. Each finger 124 includes two protrusions 126 that are employed to form the beads 122 when the fingers 124 are expanded in a conventional manner.

The end cap sub-assembly 84 is assembled or mounted on the right hand side, as seen in FIG. 1, in the same manner as sub-assembly 82 is assembled on the left hand side. The only structural difference is that the aperture 98 in the panel 32 is aligned with the middle aperture 46 of the internal panel 16. This permits the inner end 86 of the end tube 26 to loosely interfit and overlap within the end 58 of the flow tube 22.

When the muffler is assembled as described above, exhaust gases from the exhaust system may, for example, enter the muffler through the end tube 24. These gases then flow into the interior of the flow tube 18 where they can escape or expand, through the perforations in that tube, into the center chamber 72. the gases may additionally flow into the right hand chamber 74 through the open end 62. The exhaust gases may also flow between the chambers 68, 72, and 74 through the apertures 56 in the internal panels 14 and 16. The gases pass into the interior of the flow tube 22, through its perforations, as well as through its end 62. The gases then pass into the end tube 26 and out of the muffler through the other end 88 of the tube 26.

The preferred embodiment of the present invention has now been described. This preferred embodiment constitutes the best mode contemplated by the inventors for carrying out their present invention. The invention, and the manner and process of making and using it, have been described, it is believed, in such full, clear, concise and exact terms as to enable any person skilled in this art to make and use the same. Because the present invention may be copied, without copying the precise details of the preferred embodiment, the following claims particularly point out and distinctly claim the subject matter which the inventors regard as their invention and wish to protect.

We claim:

1. An improved muffler for a vehicular exhaust system used with an internal combustion engine comprising:

A. reversing unit sub-assembly having first and second ends comprising:

a first panel having first and second, oppositely facing side surfaces, a peripheral edge, an aperture, an aperture flange that surrounds the first panel aperture and that projects perpendicularly from the plane of the first panel, and a peripheral flange that is disposed adjacent to the peripheral edge of the first panel and that projects perpendicularly from one of the side surfaces of the first panel, with the first panel being disposed adjacent to the first end of the reversing unit sub-assembly so that the first surface of the first panel faces the first end of the reversing unit sub-assembly and so that the second surface of the first panel faces the second end of the reversing unit sub-assembly;

a first flow tube having first and second ends, with the first end of the first flow tube extending into and through the first panel aperture so that the leading end of the first end of the first flow tube is adjacent to the first surface of the first panel and so that the second end of the first flow tube is adjacent to the second surface of the first panel, and with the first end of the first flow tube having a pre-selected inner diameter; and first means for mechanically locking the first end of the first flow tube in the first panel aperture;

B. an inner sheet metal wrapper having an inner surface, an outer surface, a first side edge, a second side edge, and first and second end edges that are joined together, with the inner wrapper being configured so that the reversing unit sub-assembly is disposed within the inner wrapper, so that the inner wrapper extends around the peripheral edge of the first panel, so that the inner surface of the inner wrapper is in contact with but is metallurgically unbonded to the peripheral flange of the first panel, and so that the first panel is adjacent to the first side edge of the inner wrapper;

C. an outer sheet metal wrapper having an inner surface, an outer surface, a first side edge, a second side edge and first and second end edges that are joined together, with the outer wrapper extending around the inner wrapper so that its inner surface is adjacent to the outer surface of the inner wrapper, so that its first and second side edges are adjacent to the first and second side edges, respectively, of the inner wrapper and so that the outer surface of the outer wrapper serves as the outer surface of the muffler;

D. a first end cap sub-assembly that is assembled onto the first end of the assembled reversing unit sub-assembly, inner wrapper and outer wrapper, with the first cap sub-assembly including:

a first end panel having a first side surface, a second side surface, a peripheral edge that is adjacent to the first side edges of the inner and outer wrappers, an aperture in the first end panel, an aperture flange that surrounds the first end panel aperture and that projects perpendicularly from the plane of the first side surface of the first end panel;

a first end tube that has first and second ends and that is disposed, between its ends, within the first end panel aperture, with the outer diameter of the first end of the first end tube being preselected, with respect to the inner diameter of the first end of the first flow tube, so that the first end of the first end tube fits loosely, telescopically and overlappingly within the first end of the first flow tube during assembly of the first end of the first end tube within the first end of the first flow tube so as to minimize any possibility that forces applied in assembling the first end cap sub-assembly onto the first end of the reversing unit sub-assembly and in handling and using the muffler will cause axial displacement of the first panel relative to the inner wrapper;

E. second means for mechanically locking the first end tube within the first end panel aperture;

F. third means for mechanically locking together the overlapped first ends of the first end tube and the first flow tube; and G. fourth means for joining the first side edge of the outer wrapper and the peripheral edge of the first end panel.

2. The improved muffler of claim 1 wherein the third mechanical locking means includes a circumferential, skewed bead in the overlapped ends of the first end tube and the first flow tube; where the plane of the skewed bead is at an oblique angle with the central longitudinal axes of the overlapped ends; and where the skewed bead maintains the relative axial positions of the overlapped ends and resists relative movement between the overlapped ends due to the application of torsional and axial forces that the tubes experience during fabrication of the muffler and during the assembly of the muffler with the vehicular exhaust system.

3. The improved muffler of claim 2 wherein the skewed bead is continuous, but segmented, and extends beyond the surface of the first panel on one side and beyond the distal end of the first panel aperture flange on the other side.

4. The improved muffler of claim 3 wherein the skewed bead is also included in the first panel aperture flange.

5. The improved muffler of claim 4 wherein the first end panels aperture flange projects from the first surface of the first end panel; wherein the second mechanical locking means includes: a continuous, circumferential bead in the part of the first end tube adjacent to the second surface of the first end panel, with the plane of the circumferential bead being at an angle of substantially ninety degrees with respect to the longitudinal axis of the first end tube; and a series of spaced apart, circumferential, aligned elongated deformations in the overlapped portion of the first end tube and the first end panel aperture flange, with the plane of these deformations being at an angle of substantially ninety degrees with respect to the longitudinal central axis of the first end tube and where the major axes of the deformations are aligned with the plane of the deformations.

6. The improved muffler of claim 1 wherein at least a portion of the flow tube, between the first panel and the second end of the first flow tube, is perforated to permit the expansion of exhaust gases within the muffler.

7. The improved muffler of claim 1 wherein the first end panel aperture flange projects from the first surface of the first end panel; wherein the second mechanical locking means includes: a continuous, circumferential bead in the part of the first end tube adjacent to the second surface of the first end panel, with the plane of the circumferential bead being at an angle of substantially ninety degrees with respect to the longitudinal axis of the first end tube; and a series of spaced apart, circumferential, aligned elongated deformations in the overlapped portion of the first end tube and the first end panel aperture flange where the plane of these deformations is at an angle of substantially ninety degrees with respect to the longitudinal central axis of the first end tube.

8. The improved muffler of claim 7 where the major axes of the deformations are aligned with the plane of the deformations.

9. The improved muffler of claim 1 wherein the reversing unit sub-assembly also includes: a second panel having first and second, oppositely facing side surfaces, a peripheral edge, an aperture, an aperture flange that surrounds the second panel aperture and that projects generally perpendicularly from the plane of the second panel, and a peripheral flange that is adjacent to the peripheral edge of the second panel and that projects perpendicularly from the plane of the second panel, with the second panel being adjacent to the second end of the reversing unit sub-assembly and with the first surface of the second panel facing the second end of the reversing unit sub-assembly and with the second surface of the second panel facing the first end of the reversing unit sub-assembly; wherein the reversing unit subassembly further includes a second flow tube having first and second ends and extending into and through the second panel aperture so that the first end of the second flow tube is adjacent to the first surface of the second panel and so that the second end of the second flow tube is adjacent to the second surface of the second panel, with the first end of the second flow tube having a preselected inner diameter; which includes fifth means for mechanically locking the first end of the second flow tube in the second panel aperture; wherein the inner wrapper is also configured to extend around the periphery of the second panel so that the inner surface of the inner wrapper is in contact with but is metallurgically unbonded to the peripheral flange of the second panel and so that the second panel is adjacent to the second side edge of the inner wrapper; which includes a second end cap assembly having: a second end panel having a peripheral edge, an aperture, and an aperture flange that surrounds the second end panel aperture and that projects generally perpendicularly from the plane of the second end panel; and a second end tube that has first and second ends, that is disposed, between its ends, within the second end panel aperture; wherein the first end of the second end tube has a preselected outer diameter so that the first end of the second end tube may be loosely, telescopically and overlappingly fitted within the first end of the second flow tube so as to minimize the possibility that the force applied in assembling the second end cap sub-assembly onto the second end of the reversing unit sub-assembly will cause axial displacement of the second panel relative to the inner wrapper; which includes sixth means for mechanically locking the first end of the second end tube within the second end panel aperture; and which includes seventh means for mechanically locking together the overlapped first ends of the second end tube and the second flow tube.

10. The improved muffler of claim 9 wherein each of the third and seventh mechanical locking means includes a circumferential, skewed bead in the overlapped ends of the end tubes and flow tubes, where the plane of the skewed bead is at an oblique angle with the central longitudinal axes of the overlapped ends and where the skewed bead maintains the relative axial positions of the overlapped ends and resists relative movement between the overlapped ends due to the application of torsional and axial forces that the tubes experience during the assembly of the muffler.

11. The improved muffler of claim 10 wherein each skewed bead is segmented, continuous, and extends beyond the surface of the body of the adjacent panel on one side and beyond the distal end of the panel aperture flange on the other side; and wherein each skewed bead is also included in the panel aperture flange.

12. The improved muffler of claim 11 wherein the first and second end panel apertures flange projects from the first surfaces of the first and second end panel, respectively; wherein each of the second and sixth mechanical locking means includes: a continuous, circumferential bead in the part of the end tube adjacent to the second surface of the end panel, with the plane of the circumferential bead being at an angle of substantially ninety degrees with respect to the longitudinal axis of the end tube; and a series of spaced apart, circumferential, aligned elongated deformations in the overlapped portions of the end tube and the end panel aperture flange, with the plane of these deformations being at an angle of substantially ninety degrees with respect to the longitudinal central axis of the respective end tube.

13. The improved muffler of claim 12 where the major axes of the deformations are aligned with the plane of the deformations.

14. The improved muffler of claim 9 wherein the first and second end panel apertures flange projects from the first surfaces of the first and second end panel, respectively; wherein each of the second and sixth mechanical locking means includes: a continuous, circumferential bead in the part of the end tube adjacent to the second surface of the end panel, with the plane of the circumferential bead being at an angle of substantially ninety degrees with respect to the longitudinal axis of the end tube; and a series of spaced apart, circumferential, aligned elongated deformations in each overlapped portions of the end tube and the end panel aperture flange, with the plane of these deformations being at an angle of substantially ninety degrees with respect to the longitudinal central axis of the respective end tube.

15. An improved muffler for a vehicular exhaust system used with an internal combustion engine comprising:

A. a reversing unit sub-assembly having first and second ends and comprising:

a first panel having first and second, oppositely facing side surfaces, a peripheral edge, an aperture, an aperture flange that surrounds the first panel aperture and that projects perpendicularly from the plane of the first panel, and a peripheral flange that is disposed adjacent to the peripheral edge of the first panel and that projects perpendicularly from one of the side surfaces of the first panel, with the first panel being disposed adjacent to the first end of the reversing unit sub-assembly so that the first surface of the first panel faces the first end of the reversing unit sub-assembly and so that the second surface of the first panel faces the second end of the reversing unit sub-assembly;

a flow tube having first and second ends, with the first end of the flow tube extending into and through the first panel aperture so that the leading end of the first end of the flow tube is adjacent to the first surface of the first panel and so that the second end of the flow tube is adjacent to the second surface of the first panel, and with the first end of the flow tube having pre-selected inner diameter; and first means for mechanically locking the first end of the flow tube in the first panel aperture;

B. an inner sheet metal wrapper having an inner surface, an outer surface, a first side edge, a second side edge, and first and second end edges that are joined together, with the inner wrapper being configured so that the reversing unit sub-assembly is disposed within the inner wrapper, so that the inner wrapper extends around the peripheral edge of the first panel, so that the inner surface of the inner wrapper is in contact with but is metallurgically unbonded to the peripheral flange of the first panel, and so that the first panel is adjacent to the first side edge of the inner wrapper;

C. an outer sheet metal wrapper having an inner surface, an outer surface, a first side edge, second side edge and first and second end edges that a rejoined together, with the outer wrapper extending around the inner wrapper so that its inner surface is adjacent to the outer surface of the inner wrapper, so that its first and second side edges are adjacent to the first and second side edges, respectively, of the inner wrapper and so that the outer surface of the outer wrapper serves as the outer surface of the muffler;

D. a first end cap sub-assembly that is assembled onto the first end of the assembled reversing unit sub-assembly, inner wrapper and outer wrapper, with the first cap sub-assembly including:

a first end panel having a first side surface, a second side surface, a peripheral edge that is adjacent to the first side edges of the inner and outer wrappers, an aperture in the first end panel, an aperture flange that surrounds the first end panel aperture and that projects perpendicularly from the plane of the first side surface of the first end panel;

a first end tube that has first and second ends and that is disposed, between its ends, within the first end panel aperture with the first end of the first end tube having a preselected outer diameter so that the first end of the first end tube fits loosely telescopically and overlappingly within the first end of the first flow tube so as to minimize the possibility that forces applied in assembling the first end cap sub-assembly onto the first end of the reversing unit sub-assembly will cause axial displacement of the first panel relative to the inner wrapper;

E. second means for mechanically locking the first end tube within the first end panel aperture;

F. third means for mechanically locking together the overlapped first ends of the first end tube and the first flow tube; the third mechanical locking means including a circumferential, continuous, series of zig-zag arranged beads in the overlapped ends of the first end tube and the first flow tube, where the one ends of the zig-zag beads extend beyond the surface of the first panel, where the other ends of the zig-zag beads extend beyond the distal end of the first panel aperture flange, and where the zig-zag beads maintain the relative axial positions of the overlapped ends and resist relative movement between the overlapped ends due to the application of torsional and axial forces that the tubes experienced during fabrication of the muffler and during assembly of the muffler with the vehicular exhaust system; and G. fourth means for joining the first side edge of the outer wrapper and the peripheral edge of the first end panel.

16. An improved muffler for a vehicular exhaust system used with an internal combustion engine comprising:

a wrapper having an inner surface, first and second end edges that are joined together, and first and second side edges, with the body being configured so that its inner surface defines a volume, between its first and second side edges, having a predetermined cross-sectional configuration;

a first panel having a peripheral edge generally congruent with the predetermined cross-sectional configuration, a peripheral flange that extends about the peripheral edge and that projects perpendicularly from the adjacent plane of the first panel, an aperture, and an aperture flange that surrounds the first panel aperture and that projects perpendicularly from the adjacent plane of the first panel, with the first panel being disposed within the volume defined by the inner surface of the wrapper so that the inner surface of the wrapper is in contact with but is metallurgically unbonded to the panel flange;

a first flow tube disposed, at least in part, within the volume defined by the wrapper and having a first end that is disposed within and extends through the first panel aperture, with the first end of the first tube having a preselected inner diameter;

a first end tube that extends from without to within the volume defined by the wrapper and between the first side edge of the body wrapper and that has a first end, with the outer diameter of the first end of the first end tube being preselected, with respect to the inner diameter of the first end of the first flow tube so that the first end of the first end tube fits loosely, telescopically and overlappingly within the first end of the first flow tube during assembly of the first end of the end tube into the first end of the first flow tube so as to minimize the possibility that forces applied in assembling the first end of the first end tube into the first end of the first flow tube and in handling and using the muffler will cause axial displacement of the first panel relative to the wrapper, with the leading end of the first end of the first end tube extending within the first end of the first flow tube to a point beyond the plane of the first panel; and first means for mechanically locking together the overlapped first end of the first end tube and the first end of the first flow tube so as to maintain the relative axial positions of the overlapped ends and to resist relative movement between the overlapped ends due to the application of torsional and axial forces that the tubes experience during the fabrication of the muffler and during assembly of the muffler with the vehicular exhaust system.

17. The improved muffler of claim 16 which includes an end panel that has first and second oppositely facing side surfaces, and that has a peripheral edge generally congruent with the predetermined cross sectional configuration, an aperture, an aperture flange that surrounds the end panel aperture and that projects generally perpendicularly from the adjacent plane of the first surface of the end panel, with the end panel being disposed adjacent to the first side edge of the wrapper; wherein the end tube extends through the end panel aperture; which further includes second means for mechanically locking the end tube within the end panel aperture; and which includes third means for mechanically locking the first tube in the first panel aperture.

18. The improved muffler of claim 17 wherein a portion of the surface of the first tube is perforated so as to permit expansion of exhaust gases within the volume defined by the inner surface of the wrapper; wherein the first mechanical locking means includes a circumferential, skewed bead in the overlapped ends of the flow tube and the end tube, with the plane of the skewed bead being at an angle less than ninety degrees with respect to the central longitudinal axes of the overlapped ends; and wherein the skewed bead extends beyond the surface of the first panel on one side and beyond the distal end of the first panel aperture flange on the other side.

19. The improved muffler of claim 18 wherein the second mechanical locking means includes: a continuous, circumferential bead in the part of the end tube adjacent to the second surface of the end panel, with the plane of the circumferential bead being at an angle of substantially ninety degrees with respect to the longitudinal axis of the end tube; and a series of spaced apart, circumferential, aligned, elongated deformations in the overlapped portion of the end tube and the end panel aperture flange, with the plane of these deformations being at an angle of substantially ninety degrees with respect to the longitudinal central axis of the end tube.

20. The improved muffler of claim 16 wherein the second mechanical locking means includes: a continuous, circumferential bead in the part of the end tube adjacent to the second surface of the end panel, with the plane of the circumferential bead being at an angle of substantially ninety degrees with respect to the longitudinal axis of the end tube; and a series of spaced apart, circumferential, aligned, elongated deformations in the overlapped portion of the end tube and the end panel aperture flange, with the plane of these deformations being at an angle of substantially ninety degrees with respect to the longitudinal central axis of the end tube.

21. The improved muffler of claim 20 where the major axes of the deformations are aligned with the plane of these deformations.

22. An improved muffler for a vehicular exhaust system used with an internal combustion engine comprising:

a wrapper having an inner surface, first and second end edges that are joined together, and first and second side edges, with the body being configured so that its inner surface defines a volume, between its first and second side edges, having a predetermined cross-sectional configuration;

a first panel having a peripheral edge generally congruent with the predetermined cross-sectional configuration, a peripheral flange that extends about the peripheral edge and that projects perpendicularly from the adjacent plane of the first panel, an aperture, and an aperture flange that surrounds the first panel aperture and that projects perpendicularly from the adjacent plane of the first panel, with the first panel being disposed within the volume defined by the inner surface of the wrapper so that the inner surface of the wrapper is in contact with but is metallurgically unbonded to the panel flange;

a first flow tube disposed, at least in part, within the volume defined by the wrapper and having a first end that is disposed within and extends through the first panel aperture, with the first end of the first tube having a preselected inner diameter;

an end tube that extends from without to within the volume defined by the wrapper and between the first side edge of the body wrapper, with the end tube having a first end that has a preselected outer diameter so that the first end of the end tube fits loosely, telescopically and overlappingly within the first end of the first tube so as to minimize the possibility that forces applied in assembling the first ends will cause axial displacement of the first panel relative to the wrapper, with the leading end of the first end of the end tube extending within the first end of the first flow tube to a point beyond the plane of the first panel; and first means for mechanically locking together the overlapped first end of the end tube and the first end of the flow tube so as to maintain the relative axial positions of the overlapped ends and to resist relative movement between the overlapped ends due to the application of torsional and axial forces that the tubes experience during the fabrication of the muffler and during assembly of the muffler with the vehicular exhaust system, the first mechanical locking means including a circumferential, continuous, series of zig-zag arranged beads in the overlapped ends of the first end tube and the first flow tube, where the one ends of the zig-zag beads extend beyond the surface of the first panel, where the other ends of the zig-zag beads extend beyond the distal end of the first panel aperture flange, and where the zig-zag beads maintains the relative axial positions of the overlapped ends and resist relative movement between the overlapped ends due to the application of torsional and axial forces that the tubes experience during fabrication of the muffler and during assembly of the muffler with the vehicular exhaust system.

23. In a muffler for a vehicular exhaust system used with an internal combustion engine and including: an internal panel having a first and second oppositely facing side surfaces and an aperture, a flange that surrounds the internal panel aperture and that projects perpendicularly from the plane of the internal panel; a flow tube having a first end and a second end, with the first end having a preselected inner diameter, the improvement comprising: means for mechanically locking the first end of the flow tube in the internal panel aperture so that the first end of the flow tube extends through the internal panel aperture, so that the leading edge of the first end of the flow tube is adjacent to the first surface of the internal panel, and so that the second end of the flow tube is adjacent to the second surface of the internal panel, an end tube having a first end whose outer diameter is preselected, with respect to the inner diameter of the first end of the flow tube, such that the first end of the end tube loosely, telescopically and overlappingly fits within the first end of the flow tube; a circumferential skewed bead in the overlapped first ends of the flow tube and end tube, where the plane of the skewed bead is at an angle less than ninety degrees with respect to the central longitudinal axes of the overlapped ends of the tubes, and where skewed bead maintains the relative axial positions of the overlapped ends and resists relative movement between the overlapped ends due to the application of torsional and axial forces that the tubes experience during the assembly of the muffler.

24. The improved muffler of claim 23 wherein the first end of the end tube extends through the aperture in the internal panel; and wherein the skewed bead extends beyond the first surface of the internal panel on one side and beyond the distal end of the internal panel aperture flange on the other side.

25. The improved muffler of claim 24 wherein the aperture flange projects from the second surface of the internal panel; and wherein the bead is also included in the aperture flange.

26. An improved muffler for a vehicular exhaust system used with an internal combustion engine and including: a panel having a first and second oppositely facing side surfaces and an aperture having a preselected inner diameter; a flange that surrounds the panel aperture, that has a preselected inner diameter substantially identical to the preselected inner diameter of the aperture, and that projects perpendicularly from the plane of the first side surface of the panel; a flow tube having a first end, with the first end having a preselected outer diameter so that the first end of the flow tube may be fit within the panel aperture and panel aperture flange, and with the first end of the flow tube being disposed in the panel aperture so that the panel aperture flange overlaps a portion of the flow tube adjacent to the first end of the flow tube; an end tube having a first end, with the first end of the end tube having a preselected outer diameter so that the first end of the tube may fit within the first end of the flow tube and so that the portion of the flow tube overlaps the first end of the end tube; means for mechanically locking the first end of the flow tube and the first end of the end tube together and within the panel aperture and panel aperture flange, the mechanical locking means including a continuous, circumferential, skewed bead in the panel and in the overlapped panel aperture flange flow tube and end tube, the bead extending beyond the second side surface of the panel, on one side, and beyond the distal end of the panel aperture flange, on the other side, with the plane of the skewed bead being at an angle of less than ninety degrees with respect to the central longitudinal axis of the flow tube; and with the skewed bead maintaining the relative axial positions of the panel, the end tube and the flow and resisting relative axial and rotational movement between the panel, the end tube and the flow tube due to the application of torsional and axial forces that the tubes experience during the fabrication of the muffler and during assembly of the muffler with the vehicular exhaust system.

27. In a muffler for a vehicular exhaust system used with an internal combustion engine, with the muffler including: an end panel having a first and second oppositely facing side surfaces and an aperture therethrough and having a flange that surrounds the aperture and that projects perpendicularly from the plane of the first surface of the end panel, the improvement including: an end tube that extends through the end panel aperture and the aperture flange, that has a preselected outer diameter portion so that the portion of the end tube fits loosely within the end panel aperture and the aperture flange, and that has a longitudinal central axis; and means for mechanically locking the end tube portion and the end panel, the mechanical locking means including a continuous, circumferential bead in the part of the end tube portion adjacent to the second surface of the end panel, where the plane of the circumferential bead is disposed at an angle of ninety degrees with respect to the longitudinal axis of the end tube; and a plurality of spaced apart, circumferential, aligned, elongated, non-spherical deformations in the overlapped part of the end tube portion and the end panel aperture flange, with each of the elongated deformations each having major longitudinal axes, and where the planes of these elongated deformations, which planes include their longitudinal axes, are disposed at an angle of ninety degrees with respect to the longitudinal central axis of the end tube.

28. The improved muffler of claim 27 where the major axes of the deformations are aligned with the plane of the deformations.

* * * * *